US012022859B2

(12) United States Patent
Hejazi et al.

(10) Patent No.: US 12,022,859 B2
(45) Date of Patent: Jul. 2, 2024

(54) THERMAL ENERGY ABSORBERS FOR TOBACCO HEATING PRODUCTS

(71) Applicant: R.J. Reynolds Tobacco Company, Winston-Salem, NC (US)

(72) Inventors: Vahid Hejazi, Concord, NC (US); Yi-Ping Chang, Greensboro, NC (US); Luis Monsalud, Kernersville, NC (US); Darrell Williams, Winston-Salem, NC (US); Billy T. Conner, Clemmons, NC (US); Karen Cleckley, Kernersville, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 426 days.

(21) Appl. No.: 16/515,654

(22) Filed: Jul. 18, 2019

(65) Prior Publication Data

US 2021/0015171 A1 Jan. 21, 2021

(51) Int. Cl.
*A24D 3/10* (2006.01)
*A24D 3/04* (2006.01)

(52) U.S. Cl.
CPC ..... *A24D 3/10* (2013.01); *A24D 3/041* (2013.01)

(58) Field of Classification Search
CPC ..... A24D 3/041; A24D 3/10; A24D 3/163
See application file for complete search history.

(56) References Cited

U.S. PATENT DOCUMENTS 1,541,891 A 6/1925 Becker
1,607,132 A 11/1926 Kuno
1,941,531 A 1/1934 Blankenship
2,008,433 A 7/1935 Ashour
2,779,340 A 1/1957 Mansfield
2,976,190 A * 3/1961 Meyer ..... A24D 1/002 131/331
4,708,151 A 11/1987 Shelar
4,714,082 A 12/1987 Banerjee et al.
(Continued)

FOREIGN PATENT DOCUMENTS

CN 206472844 9/2017
WO WO1995034226 12/1995
(Continued)

OTHER PUBLICATIONS

Machine translation of CN206472844 (Year: 2021).*
(Continued)

*Primary Examiner* — Christopher M Rodd
*Assistant Examiner* — Jennifer A Kessie
(74) *Attorney, Agent, or Firm* — Womble Bond Dickinson (US) LLP

(57) ABSTRACT

The present disclosure provides thermal energy absorbers for use in smoking articles. In an example embodiment, the smoking article may comprise an outer wrap circumscribing at least a portion of the smoking article, wherein the smoking article is defined by an upstream lighting end and a downstream mouth end, a carbon heat source positioned proximate the lighting end, a tobacco material positioned downstream of the carbon heat source and spatially separated from the mouth end of the smoking article, and a thermal energy absorber at least partially positioned between the tobacco material and the carbon heat source.

19 Claims, 7 Drawing Sheets

(56) References Cited

U.S. PATENT DOCUMENTS

| | | | | |
|---|---|---|---|---|
| 4,966,171 | A | 10/1990 | Serrano et al. | |
| 4,991,606 | A | 2/1991 | Serrano et al. | |
| 5,040,552 | A | 8/1991 | Schleich et al. | |
| 5,060,676 | A | 10/1991 | Hearn et al. | |
| 5,076,296 | A | 12/1991 | Nystrom et al. | |
| 5,159,940 | A | 11/1992 | Hayward et al. | |
| 5,178,165 | A | 1/1993 | DeFelice | |
| 5,240,012 | A | 8/1993 | Ehrman et al. | |
| 5,592,955 | A | 1/1997 | Keritsis | |
| 5,595,577 | A | 1/1997 | Bensalem et al. | |
| 5,692,525 | A | 12/1997 | Counts et al. | |
| 5,845,649 | A | 12/1998 | Saito et al. | |
| 6,006,757 | A | 12/1999 | Lichtenberg | |
| 6,053,176 | A | 4/2000 | Adams et al. | |
| 6,164,287 | A | 12/2000 | White | |
| 6,311,694 | B1 | 11/2001 | Nichols et al. | |
| 6,345,625 | B1 | 2/2002 | Chew | |
| 6,371,127 | B1 | 4/2002 | Snaidr et al. | |
| 6,532,965 | B1 | 3/2003 | Abhulimen et al. | |
| 6,615,843 | B2 | 9/2003 | Pera | |
| 6,748,955 | B2 | 6/2004 | Snaidr et al. | |
| 7,080,649 | B2 | 7/2006 | Hcu | |
| 7,503,330 | B2 | 3/2009 | Borschke et al. | |
| 7,600,517 | B1 | 10/2009 | Holzrichter | |
| 7,624,739 | B2 | 12/2009 | Snaidr et al. | |
| 8,061,361 | B2 | 11/2011 | Maeder et al. | |
| 8,151,803 | B2 | 4/2012 | Inagaki | |
| 8,302,611 | B2 | 11/2012 | Rowley | |
| 8,528,567 | B2 | 9/2013 | Hajaligol | |
| 8,616,217 | B2 | 12/2013 | Tsurizumi et al. | |
| 8,776,803 | B2 | 7/2014 | Tarora et al. | |
| 8,863,754 | B2 | 10/2014 | Renaud et al. | |
| 8,915,255 | B2 | 12/2014 | Poget et al. | |
| 9,078,473 | B2 | 7/2015 | Worm et al. | |
| 9,149,072 | B2 | 10/2015 | Conner et al. | |
| 9,220,301 | B2 | 12/2015 | Banerjee et al. | |
| 9,301,546 | B2 | 4/2016 | Thomas et al. | |
| 9,332,784 | B2 | 5/2016 | Banerjee et al. | |
| 9,439,453 | B2 | 9/2016 | Conner et al. | |
| 9,532,591 | B2 | 1/2017 | Mironov | |
| 9,549,572 | B2 | 1/2017 | Dincer et al. | |
| 9,609,893 | B2 | 4/2017 | Novak, III et al. | |
| 9,629,393 | B2 | 4/2017 | Stolz et al. | |
| 9,717,273 | B2 | 8/2017 | Poget et al. | |
| 9,730,468 | B2 | 8/2017 | Poget et al. | |
| 9,801,412 | B2 | 10/2017 | Grant | |
| 9,894,930 | B2 | 2/2018 | Bonici et al. | |
| 9,918,494 | B2 | 3/2018 | Mironov et al. | |
| 9,930,915 | B2 | 4/2018 | Worm et al. | |
| 9,943,114 | B2 | 4/2018 | Batista | |
| 10,034,493 | B2 | 7/2018 | Akiyama et al. | |
| 10,111,463 | B2 | 10/2018 | Batista | |
| 10,159,277 | B2 | 12/2018 | Bonnely | |
| 10,212,968 | B2 | 2/2019 | Mironov et al. | |
| 2005/0000532 | A1* | 1/2005 | Bereman | A24B 15/288 131/352 |
| 2009/0065011 | A1 | 3/2009 | Maeder et al. | |
| 2011/0041861 | A1 | 2/2011 | Sebastian et al. | |
| 2011/0083674 | A1 | 4/2011 | Karpinsky | |
| 2013/0133675 | A1* | 5/2013 | Shinozaki | A24D 1/22 131/329 |
| 2013/0167850 | A1 | 7/2013 | Al-Aawar | |
| 2013/0228190 | A1 | 9/2013 | Weiss et al. | |
| 2014/0048085 | A1 | 2/2014 | Cox | |
| 2015/0034100 | A1 | 2/2015 | Park et al. | |
| 2015/0040924 | A1 | 2/2015 | Mironov et al. | |
| 2015/0296882 | A1 | 10/2015 | Mironov et al. | |
| 2015/0342254 | A1 | 12/2015 | Mironov et al. | |
| 2016/0007648 | A1 | 1/2016 | Sutton et al. | |
| 2016/0007649 | A1 | 1/2016 | Sampson et al. | |
| 2016/0120216 | A1 | 5/2016 | Mironov et al. | |
| 2016/0135495 | A1 | 5/2016 | Poget et al. | |
| 2016/0174609 | A1 | 6/2016 | Mironov | |
| 2016/0192704 | A1 | 7/2016 | Bonnely | |
| 2016/0316816 | A1 | 11/2016 | Lavanchy et al. | |
| 2016/0360785 | A1 | 12/2016 | Bless et al. | |
| 2017/0000189 | A1 | 1/2017 | Mironov et al. | |
| 2017/0055577 | A1 | 3/2017 | Batista | |
| 2017/0055578 | A1 | 3/2017 | Oda et al. | |
| 2017/0164654 | A1 | 6/2017 | Ademe | |
| 2017/0196261 | A1 | 7/2017 | Borges De Couraca et al. | |
| 2017/0303585 | A1 | 10/2017 | Florack et al. | |
| 2017/0318859 | A1 | 11/2017 | Batista | |
| 2018/0000165 | A1 | 1/2018 | Liu | |
| 2018/0014571 | A1 | 1/2018 | Nakano | |
| 2018/0070640 | A1 | 3/2018 | Bessant et al. | |
| 2018/0116280 | A1 | 5/2018 | Maiwald et al. | |
| 2018/0192707 | A1 | 7/2018 | Worm et al. | |
| 2018/0317560 | A1 | 11/2018 | Shinozaki et al. | |
| 2018/0325167 | A1 | 11/2018 | Grant | |
| 2018/0368468 | A1 | 12/2018 | Mishra et al. | |
| 2019/0000135 | A1 | 1/2019 | Lavanant et al. | |
| 2019/0000141 | A1 | 1/2019 | Rojo-Calderon et al. | |
| 2019/0000142 | A1 | 1/2019 | Lavanchy et al. | |
| 2019/0014818 | A1 | 1/2019 | Saygili | |
| 2019/0014820 | A1 | 1/2019 | Malgat | |
| 2019/0014821 | A1 | 1/2019 | Batista et al. | |
| 2019/0059449 | A1 | 2/2019 | Akiyama et al. | |
| 2019/0059450 | A1 | 2/2019 | Akiyama et al. | |
| 2019/0075848 | A1 | 3/2019 | Worm et al. | |
| 2019/0274350 | A1 | 9/2019 | Duc | |

FOREIGN PATENT DOCUMENTS

| | | |
|---|---|---|
| WO | WO1998054989 | 12/1998 |
| WO | WO2009022232 | 2/2009 |
| WO | WO2013072336 | 5/2013 |
| WO | WO2013149810 | 10/2013 |
| WO | WO2013189836 | 12/2013 |
| WO | WO2014037270 | 3/2014 |
| WO | WO2014156838 | 10/2014 |
| WO | WO2015097005 | 7/2015 |
| WO | WO2015128384 | 9/2015 |
| WO | WO2015151158 | 10/2015 |
| WO | WO2015184744 | 12/2015 |
| WO | WO2015197850 | 12/2015 |
| WO | WO2017042297 | 3/2017 |
| WO | WO2017108912 | 6/2017 |
| WO | WO2017114760 | 7/2017 |
| WO | WO2017115181 | 7/2017 |
| WO | WO2017115182 | 7/2017 |
| WO | WO2017115183 | 7/2017 |
| WO | WO2017115184 | 7/2017 |
| WO | WO2017115185 | 7/2017 |
| WO | WO2017115188 | 7/2017 |
| WO | WO2017115196 | 7/2017 |
| WO | WO2017207442 | 12/2017 |
| WO | WO2017212284 | 12/2017 |
| WO | WO2018170800 | 9/2018 |
| WO | WO2018201655 | 11/2018 |
| WO | WO2019010680 | 1/2019 |

OTHER PUBLICATIONS

Stephenson, "A 'Safer' Cigarette? Prove It, Say Critics", JAMA, 2000, 283(19), pp. 2507-2508. doi:10.1001/jama.283.19.2507.

"Chemical and Biological Studies on New Cigarette Prototypes That Heat Instead of Burn Tobacco", R. J. Reynolds Tobacco Company, 1988.

* cited by examiner

THERMAL ENERGY ABSORBERS FOR TOBACCO HEATING PRODUCTS

BACKGROUND

Field of the Disclosure

The present disclosure relates to smoking articles, sometimes referred to as tobacco heating products, capable of heating tobacco materials without combusting the tobacco materials contained within the tobacco heating products.

Description of Related Art

Many smoking articles have been proposed through the years as improvements upon, or alternatives to, smoking products based upon combusting tobacco for use. Some example alternatives have included devices wherein a solid or liquid fuel is combusted to transfer heat to tobacco. Such devices, commonly referred to as smoking articles or tobacco heating products, allow for tobacco materials to be heated without significant combustion or burning of the tobacco material. The point of the improvements or alternatives to smoking articles typically has been to provide the sensations associated with cigarette, cigar, or pipe smoking, without delivering considerable quantities of incomplete combustion and pyrolysis products which can be harmful to a user. See, for example, the various alternative smoking articles, aerosol delivery devices, and heat generating sources set forth in U.S. Pat. No. 7,726,320 to Robinson et al., U.S. Pat. Pub. No. 2013/0255702 to Griffith Jr. et al., and U.S. Pat. Pub. Nos. 2014/0096781 to Sears et al., and 2015/0216232 to Bless et al., which are incorporated herein by reference.

Articles that produce the taste and sensation of smoking by heating tobacco, tobacco-derived materials, or other plant derived materials, without a significant degree of burning or combustion, have suffered from inconsistent and detrimental performance characteristics. For example, overheating of tobacco heating products can cause unwanted scorching or burning of internal tobacco materials that can be harmful to a user. Accordingly, it can be desirable to provide a smoking article that can provide the sensations of cigarette, cigar, or pipe smoking, that does so without overheating the tobacco material and that does so with advantageous performance characteristics.

BRIEF SUMMARY

The present disclosure relates to thermal energy absorbers for smoking articles, such as/sometimes referred to as tobacco heating products. In various embodiments, a smoking article may comprise an outer wrap circumscribing at least a portion of the smoking article, wherein the smoking article is defined by an upstream lighting end and a downstream mouth end, a carbon heat source positioned proximate the lighting end, a tobacco material positioned downstream of the carbon heat source, and a thermal energy absorber at least partially positioned between the tobacco material and the carbon heat source. In some embodiments, the thermal energy absorber may comprise a metallic or ceramic material. In some embodiments, the thermal energy absorber may be aluminum or an alumina material. In various embodiments, the thermal energy absorber is configured to increase uniform distribution of heated air across the tobacco material.

In certain embodiments, the thermal energy absorber is in the form of one or more circular disks. In some embodiments, the one or more circular disks have an individual diameter of about 5 mm to about 9 mm and a thickness of about 0.1 mm to about 4 mm. In certain embodiments, the one or more circular disks may comprise a plurality of holes. In various other embodiments, the plurality of holes may be irregularly shaped, randomly-distributed, or distributed in a pattern.

In certain embodiments, the thermal energy absorber may be in the form of a plurality of particles. In some embodiments, the particles are substantially spherical in shape or in the shape of hollow spheres. In some embodiments, the thermal energy absorber may comprise between about 3 to about 500 particles. In various embodiments, the particles may have a diameter of about 0.1 mm to about 5 mm. In some embodiments, the thermal energy absorber comprises a material with a specific heat capacity of about 0.1 kJ/kg K to about 3 kJ/kg K.

In various embodiments, the tobacco material may further include one or more of a tobacco extract, an aerosol precursor composition, and a flavorant. In some embodiments, the tobacco material may be in a shredded or particulate form. In some embodiments, the carbon heat source may have a plurality of air inlet holes extending longitudinally therethrough. In various embodiments, the thermal energy absorber may be configured to decrease a crest temperature of the smoking article by between about 25° C. to about 75° C. and about 475° C. to about 525° C. In some such embodiments, the thermal energy absorber may be configured to decrease by about 50° C. to about 500° C. In some embodiments, the thermal energy absorber may be configured to decrease a total particulate matter (TPM) released during smoking of the smoking article. In certain other embodiments, the downstream mouth end may further comprise a filter material.

Some embodiments provide a method for reducing excess heating in a smoking article, the method may comprise: providing a smoking article that comprises a carbon heat source, a tobacco material, a thermal energy absorber, and an outer wrap circumscribing at least a portion of the smoking article, wherein the smoking article is defined by an upstream lighting end and a downstream mouth end; and positioning the thermal energy absorber at least partially between the tobacco material and the carbon heat source such that a crest temperature of the smoking article is decreased by about 50° C. to about 500° C. when the carbon heat source is lit. In some embodiments, the thermal energy absorber may be configured to increase uniform distribution of heated air across the tobacco material. In some embodiments, the thermal energy absorber may be configured to decrease a total particulate matter (TPM) released during smoking of the smoking article. In certain other embodiments, the downstream mouth end may further comprise a filter material.

These and other features, aspects, and advantages of the disclosure will be apparent from a reading of the following detailed description together with the accompanying drawings, which are briefly described below.

BRIEF DESCRIPTION OF THE FIGURES

Figure 1:
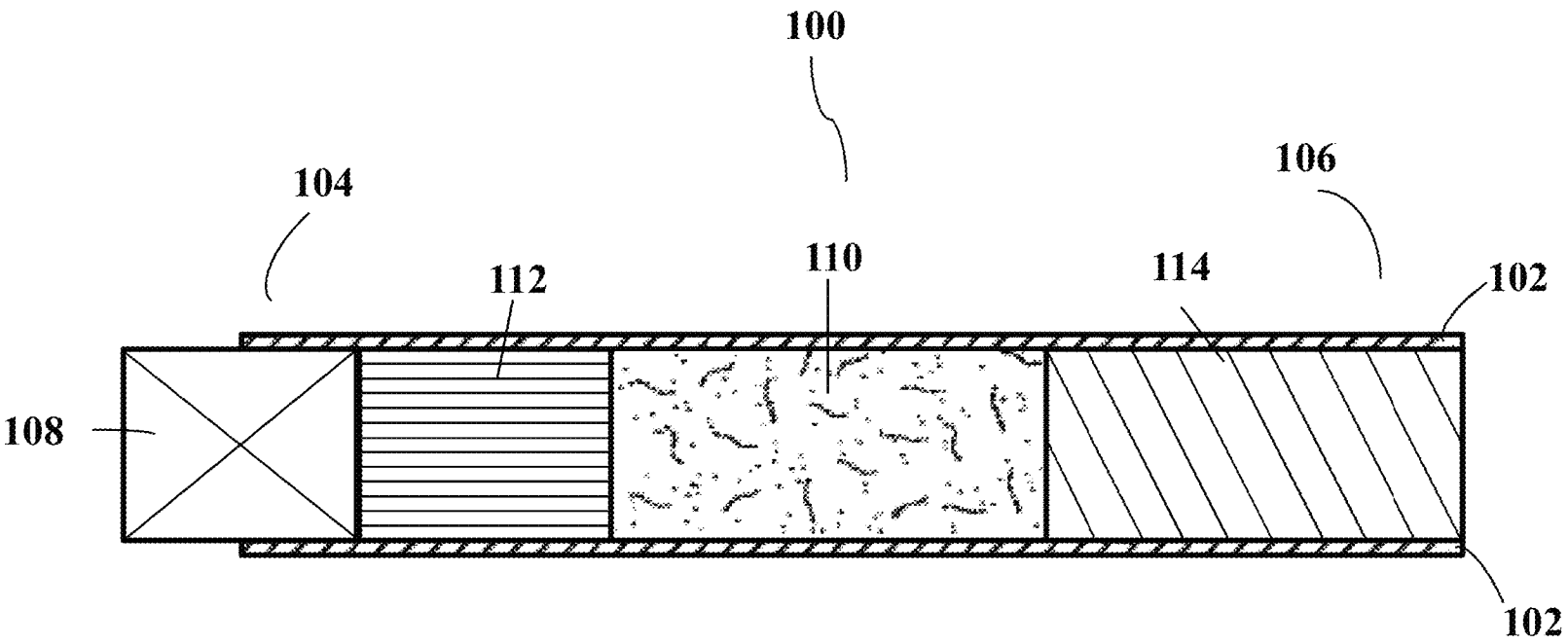
Figure 2:
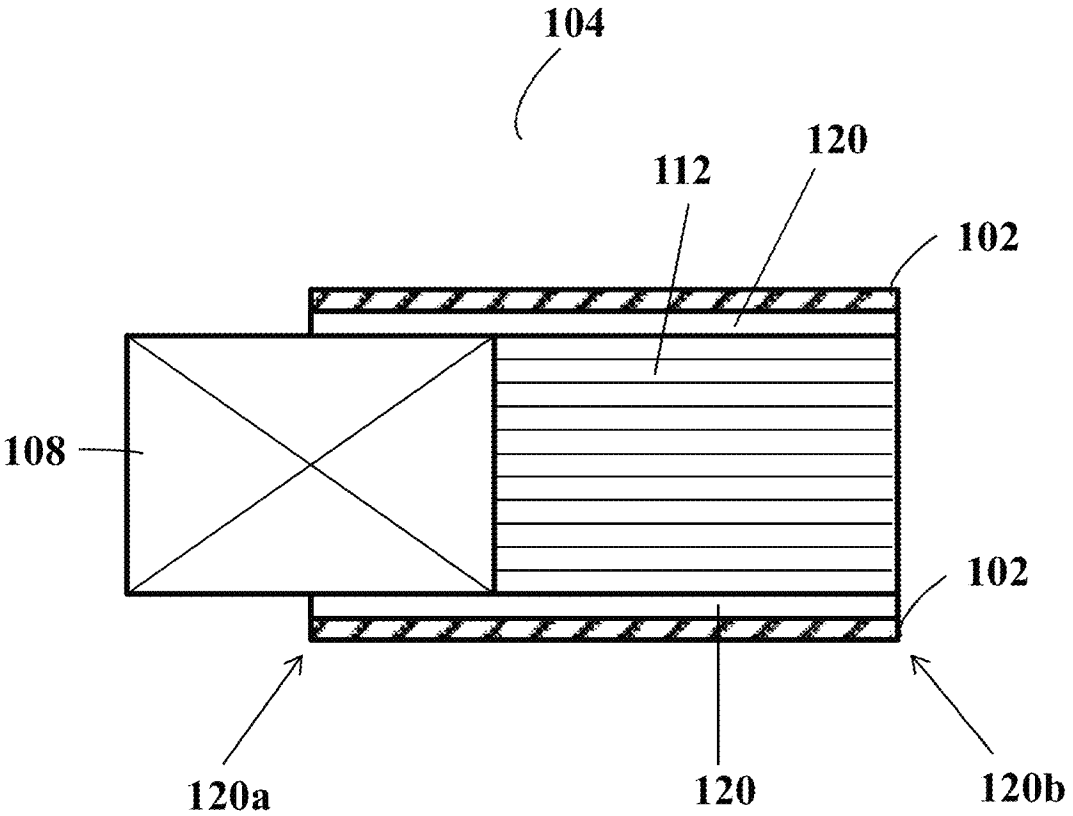
Figure 3:
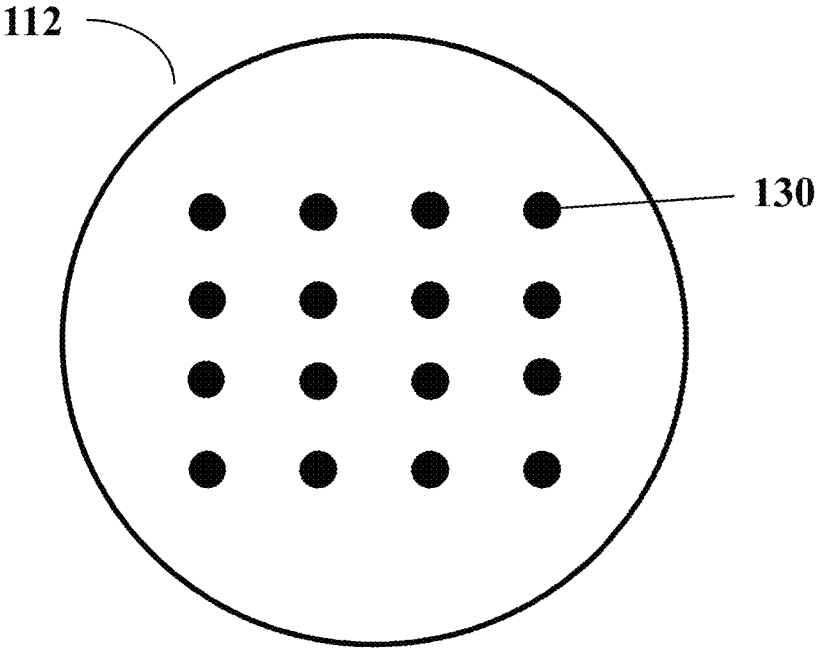
Figure 4:
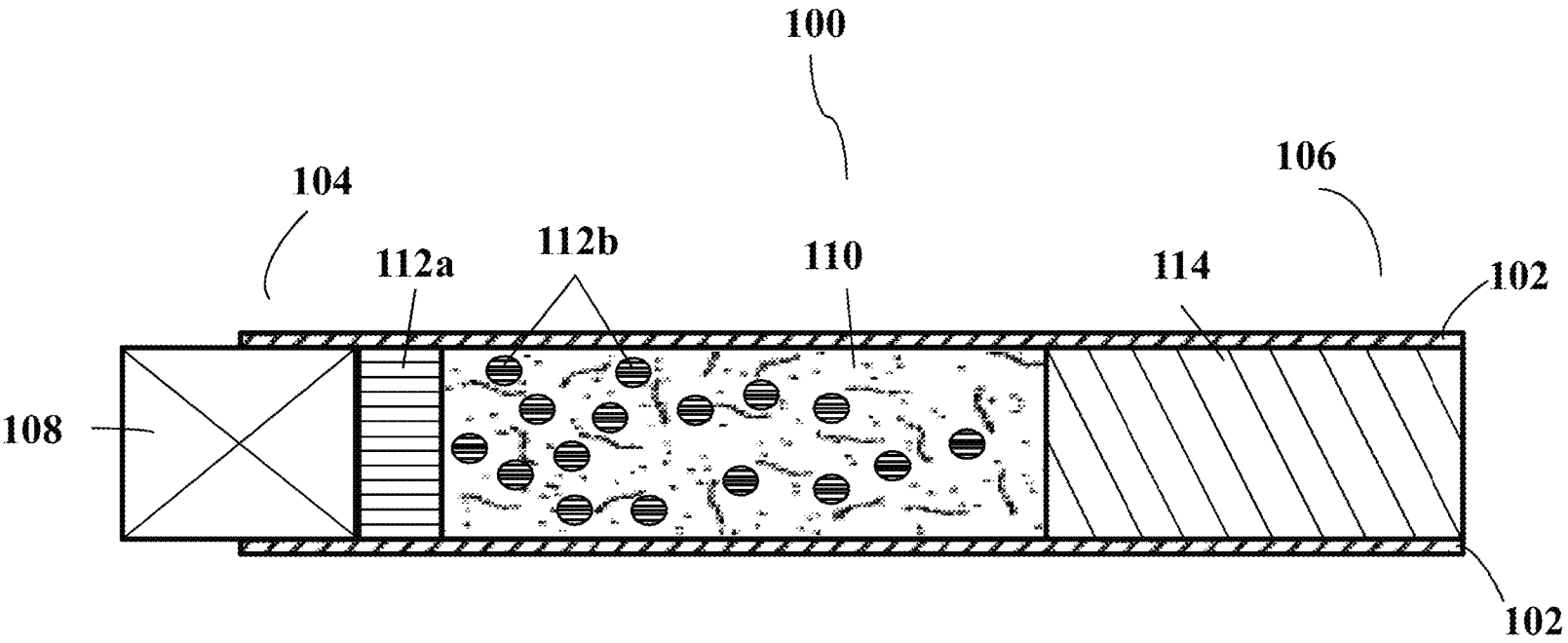
Figure 5:
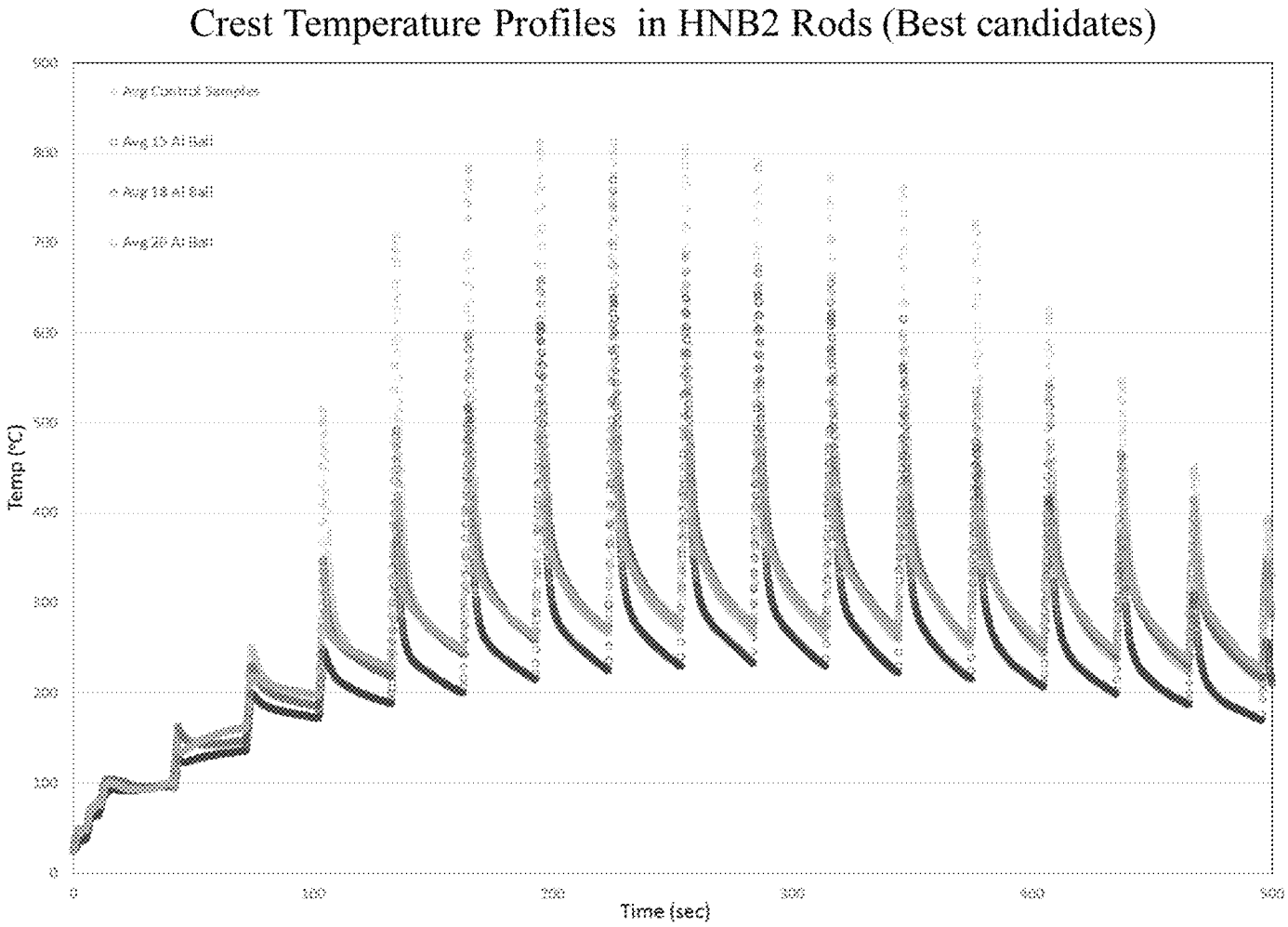
Figure 6:
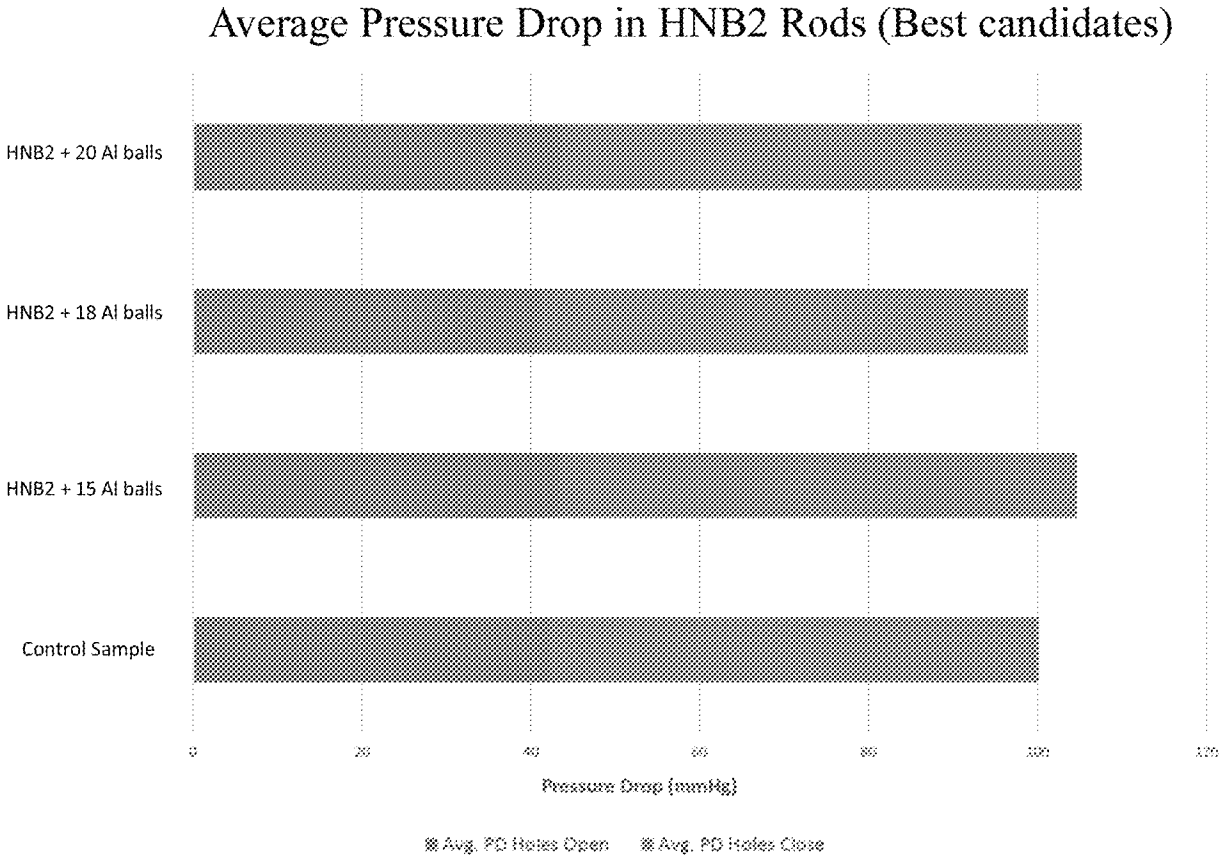
Figure 7:
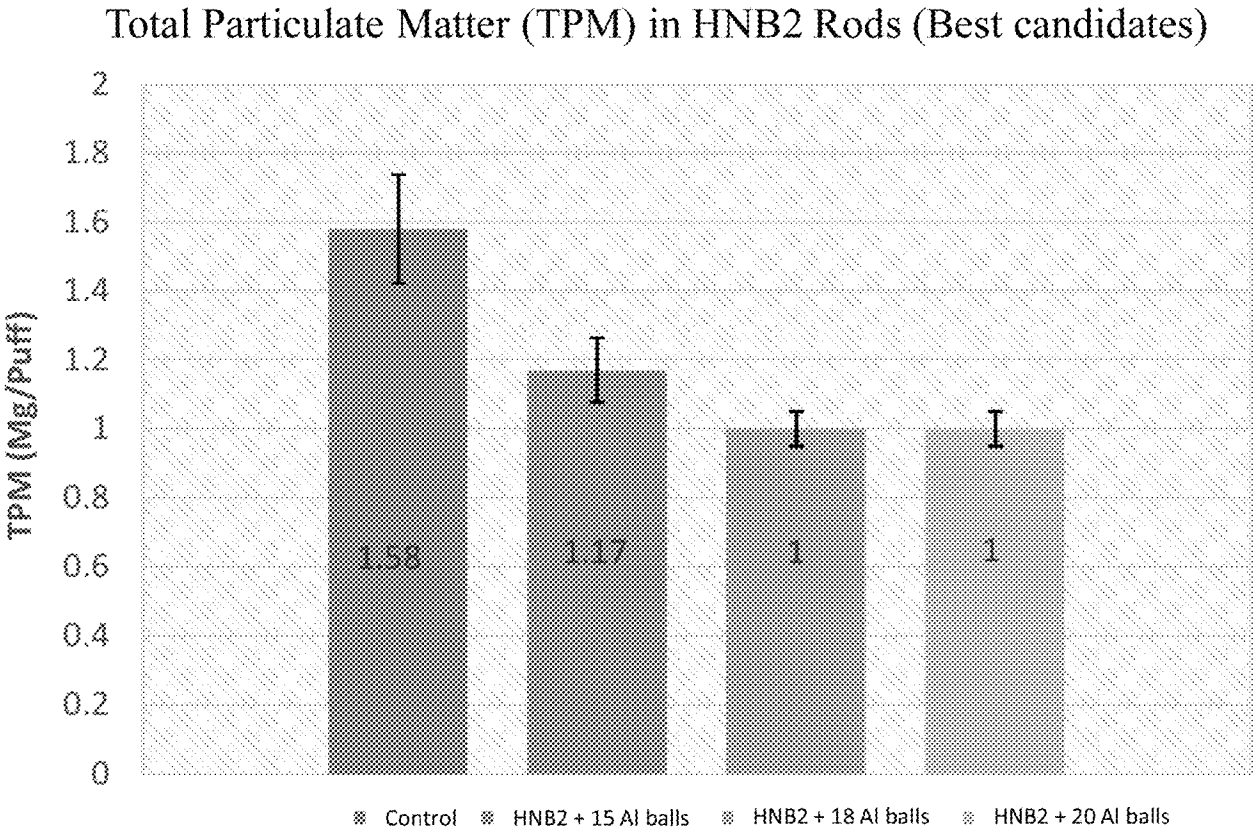

Having thus described aspects of the disclosure in the foregoing general terms, reference will now be made to the accompanying drawings, which are not necessarily drawn to scale, and wherein:

FIG. 1 illustrates a partial cross-sectional view of a smoking article according to an example embodiment of the present disclosure and including a heat source, a tobacco material, and a thermal energy absorber;

FIG. 2 illustrates a partial cross-sectional view of an upstream lighting end of a smoking article according to an example embodiment of the present disclosure and including a heat source holder;

FIG. 3 illustrates a partial cross-sectional view of a thermal energy absorber according to an example embodiment of the present disclosure;

FIG. 4 illustrates a partial cross-sectional view of a smoking article according to an example embodiment of the present disclosure and including thermal energy absorbers in the form of a plurality of particles;

FIG. 5 is a graph showing average crest temperature profiles for smoking articles without thermal energy absorbers and smoking articles including thermal energy absorbers according to example embodiments of the present disclosure;

FIG. 6 is a graph showing average pressure drop profiles for smoking articles without thermal energy absorbers according to example embodiments of the present disclosure;

FIG. 7 is a graph showing total particulate matter (TPM) released during smoking of smoking articles with and without thermal energy absorbers according to example embodiments of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the" and the like include plural referents unless the context clearly dictates otherwise. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As described hereinafter, example embodiments of the present disclosure relate to thermal energy absorbers for use in smoking articles, such as/sometimes referred to as tobacco heating products. The use of thermal energy absorbers can prevent smoking articles from overheating, which causes unwanted scorching/burning of internal tobacco materials and charring of the tipping paper of cigarette rods. Additionally, overheating of smoking articles can contribute to negative sensory attributes and result in the release of certain components from the tobacco materials. Many components of tobacco cigarette smoke are products of incomplete combustion (pyrolysis) and the thermogenic degradation of tobacco cigarettes through heat (thermogenic degradation). Typical markers of pyrolysis and thermogenic degradation of tobacco cigarettes are acetaldehyde, benzo [a]pyrene, and carbon monoxide. The use of thermal energy absorbers placed downstream of a carbon heat source can serve to decrease the degree of overheating or pyrolysis in smoking articles, and thus reduce the negative effects associated with overheating tobacco materials in smoking articles.

Some embodiments of smoking articles according to the present disclosure use an ignitable heat source to heat a material (preferably without combusting the material to any significant degree) to form an inhalable substance (e.g., carbon heated tobacco products). Preferably, the material is heated without combusting the material to any significant degree. Components of such systems have the form of articles that are substantially compact to be considered hand-held devices. That is, use of components of preferred smoking articles does not result in the production of smoke in the sense that aerosol results principally from by-products of combustion or pyrolysis of tobacco, but rather, use of those preferred systems results in the production of vapors resulting from heating, without burning or combusting, of the tobacco incorporated therein. In some example embodiments, components of smoking articles may be characterized as heat-not-burn cigarettes, and those heat-not-burn cigarettes most preferably incorporate tobacco and/or components derived from tobacco, and hence deliver tobacco-derived components in aerosol form.

Smoking articles may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of smoking articles in accordance with some example embodiments of the present disclosure can hold and use that component much like a smoker employs a traditional type of smoking article, draw on one end of that piece for inhalation of aerosol produced by that piece, take or draw puffs at selected intervals of time, and the like.

While the systems are generally described herein in terms of embodiments associated with smoking articles, it should be understood that the mechanisms, components, features, and methods may be embodied in many different forms and associated with a variety of articles. For example, the description provided herein may be employed in conjunction with embodiments of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of embodiments relating to smoking articles by way of example only, and may be embodied and used in various other products and methods.

Smoking articles of the present disclosure may also be characterized as being vapor-producing articles or medicament delivery articles. Thus, such articles or devices may be adapted so as to provide one or more substances (e.g., flavors and/or pharmaceutical active ingredients) in an inhalable form or state. For example, inhalable substances may be substantially in the form of a vapor (i.e., a substance that is in the gas phase at a temperature lower than its critical point). Alternatively, inhalable substances may be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like. The physical form of the inhalable substance is not necessarily limited by the nature of the inventive devices but rather may depend upon the nature of the medium and the inhalable substance itself as to whether it exists in a vapor state or an aerosol state. In some embodiments, the terms "vapor" and "aerosol" may be interchangeable. Thus, for simplicity, the terms "vapor" and "aerosol" as used to describe aspects of the disclosure are understood to be interchangeable unless stated otherwise.

In some embodiments, smoking articles of the present disclosure may comprise an outer wrap circumscribing at least a portion of the smoking article, wherein the smoking article is defined by an upstream lighting end and a downstream mouth end, a heat source positioned proximate the lighting end, a tobacco material positioned downstream of the heat source and spatially separated from the mouth end of the smoking article, and at least one thermal energy absorber at least partially positioned between the tobacco material and the carbon heat source. Alternative formats, configurations and arrangements of various thermal energy absorbers, smoking articles, and components within smoking articles of the present disclosure will be evident in light of the further disclosure provided hereinafter.

In this regard, FIG. 1 illustrates a smoking article 100 according to an example embodiment of the present disclosure. The smoking article 100 may include an outer wrap 102 circumscribing at least a portion of the smoking article 100, wherein the smoking article is defined by an upstream lighting end 104 and a downstream mouth end 106. In some embodiments, the smoking article 100 may further include a heat source 108, a tobacco material 110, and a thermal energy absorber 112. In certain embodiments the heat source 108 may be positioned proximate the lighting end 104. In certain embodiments, the tobacco material 110 may be positioned downstream of the carbon heat source 108 and optionally spatially separated from the mouth end 106 of the smoking article 100. In some embodiments, the thermal energy absorber 112 may be at least partially positioned between the tobacco material 110 and the heat source 108.

In various embodiments, smoking articles according to the present disclosure may have a variety of overall shapes, including, but not limited to an overall shape that may be defined as being substantially rod-like or substantially tubular shaped or substantially cylindrical shaped. In the embodiment of FIG. 1, the smoking article 100 has a substantially round cross-section; however, other cross-sectional shapes (e.g., oval, square, triangle, etc.) are also encompassed by the present disclosure. Thus, such language that is descriptive of the physical shape of the article may also be applied to the individual components thereof.

Alignment of the components within the smoking article of the present disclosure may vary across various embodiments. In some embodiments, the thermal energy absorber may be positioned entirely between the heat source and the tobacco material. In certain other embodiments, at least part of the thermal energy absorber may be comingled within the tobacco material, such that the thermal energy absorber may be only partially between the heat source and the tobacco material. Other configurations are not necessarily excluded, for example, the thermal energy absorber may be entirely comingled within the tobacco material such that the thermal energy absorber is not positioned between the heat source and the tobacco material. Generally, the heat source may be positioned sufficiently near the tobacco material so that heat from the heat source can heat, without burning or combusting, the tobacco material (as well as, in some embodiments, one or more flavorants, medicaments, or the like that may likewise be provided for delivery to a user) and form an aerosol for delivery to the user.

Further components may be utilized in the smoking article of the present disclosure, For example, referring back to FIG. 1, the smoking article 100 may include a filter 114 positioned downstream of the tobacco material 110 and proximate to the downstream mouth end 106 of the smoking article 100. In various embodiments, the filter 114, may be made of a cellulose acetate or polypropylene material. The filter 114 may additionally or alternatively contain strands of tobacco containing material, such as described in U.S. Pat. No. 5,025,814 to Raker et al., which is incorporated herein by reference in its entirety. In various embodiments, the filter 114 may increase the structural integrity of the mouth end of the smoking article 100, and/or provide filtering capacity, if desired, and/or provide resistance to draw. In some embodiments, the filter may comprise discrete segments. For example, some embodiments may include a segment providing filtering, a segment providing draw resistance, a hollow segment providing a space for the aerosol to cool, a segment providing increased structural integrity, other filter segments, and any one or any combination of the above. In various other embodiments, components may exist between the tobacco material 110 and the mouth end 106 of the smoking article 100, in addition to the filter 114. For example, in some embodiments one or any combination of the following may be positioned between the tobacco material 110 and the mouth end 106 of the smoking article 100: an air gap; a hollow tube structure; phase change materials for cooling air; flavor releasing media; ion exchange fibers capable of selective chemical adsorption; aerogel particles as filter medium; and other suitable materials. Some examples of possible phase change materials include, but are not limited to, salts, such as $AgNO_3$, $AlCl_3$, $TaCl_3$, $InCl_3$, $SnCl_2$, $AlI_3$, and $TiI_4$; metals and metal alloys such as selenium, tin, indium, tin-zinc, indium-zinc, or indium-bismuth; and organic compounds such as D-mannitol, succinic acid, p-nitrobenzoic acid, hydroquinone and adipic acid. Other examples are described in U.S. Pat. No. 8,430,106 to Potter et al., which is incorporated herein by reference in its entirety.

As noted above, in various embodiments, the smoking article 100 may comprise an outer wrap 102 circumscribing at least a portion of the smoking article 100. In some embodiments, the wrapping material of the outer wrap 102 may comprise a material that resists transfer of heat, which may include a paper or other fibrous material, such as a cellulose material. The wrapping material used as an outer wrap for circumscribing smoking articles can vary. Exemplary types of wrapping materials are set forth in U.S. Pat. No. 4,938,238 to Barnes et al. and U.S. Pat. No. 5,105,837 to Barnes et al. Wrapping materials, such as those set forth in U.S. Patent Appl. Pub. No. 2005/0005947 to Hampl, Jr. et al. and PCT Appl. Pub. No. WO 2005/039326 to Rasouli et al., can be employed as inner wrapping materials of a so-called "double wrap" configuration. An exemplary type of heat conductive wrapping material is set forth in U.S. Pat. No. 5,551,451 to Riggs et al.; and other suitable wrapping materials are set forth in U.S. Pat. No. 5,065,776 to Lawson et al. and U.S. Pat. No. 6,367,481 to Nichols et al.; each of which is incorporated herein by reference. Exemplary wrapping materials, such as laminates of paper and metal foil, and papers used as the outer circumscribing wrapper of the heat generation segment, have been incorporated within the types of cigarettes commercially marketed under the trade names "Premier" and "Eclipse" by R. J. Reynolds Tobacco Company. Other representative wrapping materials, and processed wrapping materials, suitable for use for cigarette manufacture are set forth in U.S. Pat. No. 5,220,930 to Gentry; U.S. Pat. No. 6,976,493 to Chapman et al.; and U.S. Pat. No. 7,047,982 to Seymour et al.; and U.S. patent application Ser. No. 11/377,630 filed Mar. 16, 2006 to Crooks et al.; each of which is incorporated herein by reference. The outer wrap 102 material may also include at least one filler material imbedded or dispersed within the fibrous material. In various embodiments, the filler material may have the form of water insoluble particles. Additionally, the filler material may incorporate inorganic components. In various embodiments, the outer wrap may be formed of multiple layers, such as an underlying, bulk layer and an overlying layer, such as a typical wrapping paper in a cigarette. Such materials may include, for example, lightweight "rag fibers" such as flax, hemp, sisal, rice straw, and/or esparto. The outer wrap 102 may also include a material typically used in a filter element of a conventional cigarette, such as cellulose acetate.

In some embodiments the outer wrap 102 may further comprise a heat source holder 120 positioned at least proximate to the lighting end 104 of the smoking article 100. In various embodiments the heat source holder 120 may circumscribe the heat source 108, at a proximal end 120*a* of the heat source holder 120, and the thermal energy absorber 112, at a distal end 120*b* of the heat source holder 120, as depicted in FIG. 2. In various embodiments, the heat source holder 120 may possess a certain degree of heat resistance and may be substantially tubular in shape. In some embodiments, the heat source holder 120 may hold the heat source 108 in such a manner that a pre-determined length of the heat source 108 projects from the proximal end of the heat source holder 120. In certain embodiments, the heat source holder 120 may have a peripheral wall with a laminated structure and multiple layers. For example, the peripheral wall may include one or more laminate layers, metal layers, and paper layers bonded together. In certain embodiments, one or more metal layers may be included in the heat source holder 120 such that when the carbon heat source 108 is burned and the outer wrap 102 is heated by the heat of the carbon heat source 108, the one or more metal layers keep the heating temperature of the outer wrap 102 lower than the burning temperature of the outer wrap 102. Examples of heat source holders for carbon heat sources are described in U.S. Pub. Pat. App. No. 2018/0317560 to Shinozaki et al., the disclosure of which is incorporated herein by reference in its entirety.

Referring back to FIG. 1, in various embodiments, the smoking article 100 may comprise a heat source 108 positioned proximate the lighting end 104. In certain embodiments, the carbon heat source 108 may include combustible carbonaceous materials of various types. In certain other embodiments, the carbon heat source 108 may include incombustible additives in addition to the combustible carbonaceous materials. Example carbon heat sources are described in U.S. Pub. Pat. App. No. 2018/0317560 to Shinozaki et al., which is incorporated herein by reference in its entirety. In some embodiments, the carbon heat source 108 may incorporate other elements in addition to the combustible carbonaceous materials (e.g., tobacco components, such as powdered tobaccos or tobacco extracts; flavoring agents; salts, such as sodium chloride, potassium chloride and sodium carbonate; alumina granules; ammonia sources, such as ammonia salts; and/or binding agents, such as guar gum, ammonium alginate and sodium alginate).

Although specific dimensions of an applicable carbon heat sources 108 may vary, in some embodiments, the carbon heat source 108 may have a length in an inclusive range of about 5 mm to about 20 mm, or about 8 mm to about 16 mm, or about 12 mm, and an overall diameter in an inclusive range of about 3 mm to about 8 mm. In some embodiments, the carbon heat source 108 may project out a pre-determined length from the lighting end 104, as shown in FIG. 1. Referring back to FIG. 2, in certain other embodiments, the carbon heat source 108 may project out a pre-determined length from the proximal end 120*a* of the heat source holder 120. The pre-determined length may vary, in some embodiments, the pre-determined length may have a length in an inclusive range of about 2 mm to about 12 mm, or about 6 mm to about 10 mm, or about 8 mm. Although in other embodiments, the carbon heat source 108 may be constructed in a variety of ways, in the depicted embodiment, the carbon heat source 108 is extruded or compounded using a ground or powdered carbon-based material, and has a density that is greater than about 0.5 g/cm3, often greater than about 0.7 g/cm3, and frequently greater than about 1 g/cm3, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties. Although in various embodiments, the carbon heat source 108 may have a variety of forms, including, for example, a substantially solid cylindrical shape or a hollowed cylindrical (e.g., tube) shape, the carbon heat source 108 of the depicted embodiment comprises an extruded monolithic carbonaceous material that has a generally cylindrical shape but with a plurality of air inlet holes extending longitudinally therethrough. The air inlet holes may have a variety of different shapes or substantially the same shape, and, in some embodiments, the plurality of air inlet holes may be arranged in a pattern or randomly distributed across the face of the carbon heat source and extending longitudinally therethrough. In some embodiments, the smoking article 100, and in particular, the carbon heat source 108, may further include a heat transfer component. In various embodiments, a heat transfer component may be proximate to the carbon heat source 108, and, in some embodiments, a heat transfer component may be located in or within the carbon heat source 108. Some examples of heat transfer components are described in U.S. patent application Ser. No. 15/923,735, filed on Mar. 16, 2018, and titled Smoking Article with Heat Transfer Component, which is incorporated herein by reference in its entirety.

Generally, the carbon heat source 108 is positioned sufficiently near a tobacco material 110 such that aerosol formed from heating the tobacco material 110 is deliverable to the user by way of the mouth end 106. That is, when the carbon heat source 108 heats the tobacco material 110, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of an aerosol.

As noted above, in some embodiments, the smoking article 100 may comprise a tobacco material 110 positioned downstream of the carbon heat source 108 and optionally spatially separated from the mouth end 106 of the smoking article 100. In some embodiments, the tobacco material 110 may be in particulate form, shredded form, or in the form of sheets. In some embodiments, the tobacco material may further include one or both of an aerosol precursor composition and a flavorant. The tobacco materials employed can vary. One type of tobacco can be employed, or combinations or blends of various types of tobacco can be employed. Furthermore, different types of tobaccos, or different blends of tobaccos, can be employed at different locations within the smoking article.

For example, in some embodiments the tobacco material that is employed can include, or can be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. See, also, for example, the types of tobaccos set forth in U.S. Pat. No. 6,730,832 to Dominguez et al.; and U.S. Pat. No. 7,025,066 to Lawson et al.; and U.S. Pat. Appl. Ser. No. 60/818,198, filed Jun. 30, 2006, to Stebbins et al.; each of which is incorporated herein by reference. Descriptions of various types of tobaccos, growing practices, harvesting practices and curing practices are set for in Tobacco Production, Chemistry and Technology, Davis et al. (Eds.) (1999). Most preferably, the tobacco that is employed has been appropriately cured and aged. Especially preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference.

The tobacco material that is incorporated within the smoking article can be employed in various forms; and combinations of various forms of tobacco can be employed, or different forms of tobacco can be employed at different locations within the smoking article. For example, the tobacco can be employed in the form of cut or shredded pieces of lamina or stem; in a processed form (e.g., reconstituted tobacco sheet, such as pieces of reconstituted tobacco sheet shredded into a cut filer form; films incorporating tobacco components; extruded tobacco parts or pieces; expanded tobacco lamina, such as cut filler that has been volume expanded; pieces of processed tobacco stems comparable to cut filler in size and general appearance; granulated tobacco; foamed tobacco materials; compressed or pelletized tobacco; or the like); as pieces of finely divided tobacco (e.g., tobacco dust, tobacco powder, agglomerated tobacco powders, or the like); or in the form of a tobacco extract. See, for example, U.S. patent application Ser. No. 11/194,215 filed Aug. 1, 2005, to Cantrell et al. and Ser. No. 11/377,630 filed Mar. 16, 2006 to Crooks et al.; which are incorporated herein by reference.

The smoking article can employ tobacco in the form of lamina and/or stem. As such, the tobacco can be used in forms, and in manners, that are virtually identical in many regards to those traditionally used for the manufacture of tobacco products, such as cigarettes. Traditionally, cut or shredded pieces of tobacco lamina and stem have been employed as so-called "cut filler" for cigarette manufacture. Pieces of water extracted stems also can be employed. As such, the tobacco in such a form introduces mass and bulk within the smoking article. Manners and methods for curing, de-stemming, aging, moistening, cutting, reordering and handling tobacco that is employed as cut filler will be apparent to those skilled in the art of tobacco product manufacture.

Processed tobaccos that can be incorporated within the smoking article can vary. Exemplary manners and methods for providing reconstituted tobacco sheet, including casting and paper-making techniques, are set forth in U.S. Pat. No. 4,674,519 to Keritsis et al.; U.S. Pat. No. 4,941,484 to Clapp et al.; U.S. Pat. No. 4,987,906 to Young et al.; U.S. Pat. No. 4,972,854 to Kiernan et al.; U.S. Pat. No. 5,099,864 to Young et al.; U.S. Pat. No. 5,143,097 to Sohn et al.; U.S. Pat. No. 5,159,942 to Brinkley et al.; U.S. Pat. No. 5,322,076 to Brinkley et al.; U.S. Pat. No. 5,339,838 to Young et al.; U.S. Pat. No. 5,377,698 to Litzinger et al.; U.S. Pat. No. 5,501,237 to Young; and U.S. Pat. No. 6,216,707 to Kumar; each of which is incorporated herein by reference. Exemplary manners and methods for providing extruded forms of processed tobaccos are set forth in U.S. Pat. No. 4,821,749 to Toft et al.; U.S. Pat. No. 4,880,018 to Graves, Jr. et al.; U.S. Pat. No. 5,072,744 to Luke et al.; U.S. Pat. No. 4,874,000 to Tamol et al.; U.S. Pat. No. 5,551,450 to Hemsley; U.S. Pat. No. 5,649,552 to Cho et al.; U.S. Pat. No. 5,829,453 to White; U.S. Pat. No. 6,125,855 to Nevett et al.; and U.S. Pat. No. 6,182,670 to White; each of which is incorporated herein by reference. Extruded tobacco materials can have the forms of cylinders, strands, discs, or the like. Exemplary expanded tobaccos (e.g., puffed tobaccos) can be provided using the types of techniques set forth in U.S. Pat. No. Re. 32,013 to de la Burde et al.; U.S. Pat. No. 3,771,533 to Armstrong et al.; U.S. Pat. No. 4,577,646 to Ziehn; U.S. Pat. No. 4,962,773 to White; U.S. Pat. No. 5,095,922 to Johnson et al.; U.S. Pat. No. 5,143,096 to Steinberg; U.S. Pat. No. 5,172,707 to Zambelli; U.S. Pat. No. 5,249,588 to Brown et al.; U.S. Pat. No. 5,687,748 to Conrad; and U.S. Pat. No. 5,908,032 to Poindexter; and US Pat. Pub. 2004/0182404 to Poindexter et al.; each of which is incorporated herein by reference. One particularly preferred type of expanded tobacco is dry ice expanded tobacco (DIET). Exemplary forms of processed tobacco stems include cut-rolled stems, cut-rolled-expanded stems, cut-puffed stems and shredded-steam expanded stems. Exemplary manners and methods for providing processed tobacco stems are set forth in U.S. Pat. No. 4,195,646 to Kite; U.S. Pat. No. 5,873,372 to Honeycutt et al.; each of which is incorporated herein by reference. Manners and methods for employing tobacco dust are set forth in U.S. Pat. No. 4,341,228 to Keritsis et al.; U.S. Pat. No. 4,611,608 to Vos et al.; 4,706,692 to Gellatly; and U.S. Pat. No. 5,724,998 to Gellatly et al.; each of which is incorporated herein by reference. Yet other types of processed tobaccos are of the type set forth in US Pat. Pub. No. 2006/0162733 to McGrath et al.

The tobacco can be used in a blended form. Typically, the blends of various types and forms of tobaccos are provided in a blended cut filler form. For example, certain popular tobacco blends for cigarette manufacture, commonly referred to as "American blends," comprise mixtures of cut or shredded pieces of flue-cured tobacco, burley tobacco and Oriental tobacco; and such blends, in many cases, also contain pieces of processed tobaccos, such as processed tobacco stems, volume expanded tobaccos and/or reconstituted tobaccos. The precise amount of each type or form of tobacco within a tobacco blend used for the manufacture of a particular smoking article can vary, and is a manner of design choice, depending upon factors such as the sensory characteristics (e.g., flavor and aroma) that are desired. See, for example, the types of tobacco blends described in Tobacco Encyclopedia, Voges (Ed.) p. 44-45 (1984), Browne, The Design of Cigarettes, 3rd Ed., p.43 (1990) and Tobacco Production, Chemistry and Technology, Davis et al. (Eds.) p. 346 (1999). See, also, the representative types of tobacco blends set forth in U.S. Pat. No. 4,836,224 to Lawson et al.; U.S. Pat. No. 4,924,888 to Perfetti et al.; U.S. Pat. No. 5,056,537 to Brown et al.; and U.S. Pat. No. 5,220,930 to Gentry; U.S. Patent Appl. Pub. Nos. 2004/0255965 to Perfetti et al.; and 2005/0066986 to Nestor et al.; PCT Appl. Pub. No. WO 02/37990 to Bereman; and Bombick et al., Fund. Appl. Toxicol., 39, p. 11-17 (1997); each of which is incorporated herein by reference.

Certain processed tobaccos can incorporate ingredients other than tobacco. However, it is preferred that processed tobaccos be composed predominantly of tobacco of some form, based on the dry weights of those processed tobaccos. That is, the majority of the dry weight of those processed tobaccos, and the majority of the weight of a mixture incorporating those processed tobaccos (including a blend of materials, or materials having additives applied thereto or otherwise incorporated therein), are provided by tobacco of some form. For example, those materials can be processed tobaccos that incorporate minor amounts of non-tobacco filler materials (e.g., calcium carbonate particles, spongy or absorbent materials, carbonaceous materials including carbon particles and graphite fibers, grains or wood pulp) and/or binding agents (e.g., guar gum, sodium alginate or ammonium alginate); and/or a blend of those materials can incorporate tobacco substitutes or extenders. Exemplary types of tobacco substitutes or extenders are set forth in U.S. patent application Ser. No. 11/489,334, filed Jul. 19, 2006, to Fagg et al., which is incorporated herein by reference. The foregoing materials, and blends incorporating those materials, frequently include greater than about 70 percent tobacco, often are greater than about 80 percent tobacco, and generally are greater than about 90 percent tobacco, on a dry weight basis, based on the combined weights of the tobacco, non-tobacco filler material, and non-tobacco substitute or extender. However, those processed tobaccos also can be made of virtually all tobacco, and not incorporate any non-tobacco fillers, substitutes or extenders.

The tobacco can be treated with tobacco additives of the type that are traditionally used for the manufacture of tobacco products. Those additives can include the types of materials used to enhance the flavor and aroma of tobaccos used for the production of cigars, cigarettes, pipes, and the like. For example, those additives can include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin. Preferred casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al. Additives also can be added to the tobacco using the types of equipment described in U.S. Pat. No. 4,995,405 to Lettau, or that are available as Menthol Application System MAS from Kohl Maschinenbau GmbH. The selection of particular casing and top dressing components is dependent upon factors such as the sensory characteristics that are desired, and the selection and use of those components will be readily apparent to those skilled in the art of cigarette design and manufacture. See, Gutcho, Tobacco Flavoring Substances and Methods, Noyes Data Corp. (1972) and Leffingwell et al., Tobacco Flavoring for Smoking Products (1972). The tobacco also may be treated, for example, with ammonia or ammonium hydroxide or otherwise treated to incorporate ammonia (e.g., by addition of ammonia salts such as, for example, diammonium phosphate). Preferably, the amount of ammonia optionally incorporated into the smokable tobacco is less than about 5 percent, and generally about 1 to about 3 percent, based on the dry weight of the tobacco.

Tobacco can be incorporated with the smoking article in a form other than cut filler form. For example, tobacco leaf and/or reconstituted tobacco sheet can be used as a wrapper for a tobacco-containing component having the form of a cigar or an inner wrapper of a double wrapped cigarette rod. Alternatively, processed tobaccos, such as certain types of reconstituted tobaccos, can be employed as longitudinally extending strands. See, for example, the type of configuration set forth in U.S. Pat. No. 5,025,814 to Raker, which is incorporated herein by reference. In addition, certain types of reconstituted tobacco sheets can be formed, rolled or gathered into a desired configuration. In addition, molded, compressed or extruded segments or pieces of tobacco-containing materials that are formed into desired shapes (e.g., strands, tubes, cylinders, pellets, or the like) can be incorporated within the smoking article. See, for example, U.S. Pat. No. 4,836,225 to Sudoh; U.S. Pat. No. 4,893,639 to White; U.S. Pat. No. 4,972,855 to Kuriyama et al.; and U.S. Pat. No. 5,293,883 to Edwards; each of which is incorporated herein by reference. If desired, finely milled tobacco or tobacco dust can be incorporated within other types of processed tobaccos, such as extrudate formulations, reconstituted tobacco sheets, or the like. Furthermore, finely milled tobacco or tobacco dust can be contained on substrates, such as membranes or screens. If desired, at least a portion of the tobacco can be heat treated prior to use within the smoking article (e.g., have the form of high temperature dried, toasted, pre-pyrolyzed, condensed volatiles collected after tobacco is heated, condensed tobacco smoke components, or the like).

Various manners and methods for incorporating tobacco into smoking articles, and particularly smoking articles that are designed so as to not purposefully burn virtually all of the tobacco within those smoking articles, are set forth in U.S. Pat. No. 4,947,874 to Brooks et al.; U.S. Patent Application Pub. No. 2005/0016549 to Banerjee et al.; and U.S. patent application Ser. No. 11/194,215 filed Aug. 1, 2005, to Cantrell et al. and Ser. No. 11/377,630 filed Mar. 16, 2006 to Crooks et al.; which are incorporated herein by reference. In addition, tobacco has been incorporated with cigarettes that have been marketed commercially under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Tobacco also has been incorporated within a smoking article that has been marketed commercially by Philip Morris Inc. under the brand name "Accord."

As noted above, in some embodiments, the tobacco material 110 may further comprise an aerosol precursor composition. In certain embodiments, the aerosol precursor composition may comprise glycerin or propylene glycol. Preferred aerosol forming materials include polyhydric alcohols (e.g., glycerin, propylene glycol, and triethylene glycol) and/or water, and any other materials which yield a visible aerosol, as well as any combinations thereof. Representative types of aerosol forming materials are set forth in U.S. Pat. No. 4,793,365 to Sensabaugh, Jr. et al.; and U.S. Pat. No. 5,101,839 to Jakob et al.; PCT Pat. App. Pub. No. WO 98/57556 to Biggs et al.; and Chemical and Biological Studies on New Cigarette Prototypes that Heat Instead of Burn Tobacco, R. J. Reynolds Tobacco Company Monograph (1988); which are incorporated herein by reference in their entirety. Other representative types of aerosol precursor components and formulations are also set forth and characterized in U.S. Pat. No. 7,726,320 to Robinson et al., U.S. Pat. No. 8,881,737 to Collett et al., and U.S. Pat. No. 9,254,002 to Chong et al.; and U.S. Pat. Pub. Nos. 2013/0008457 to Zheng et al.; 2015/0020823 to Lipowicz et al.; and 2015/0020830 to Koller, as well as WO 2014/182736 to Bowen et al, the disclosures of which are incorporated herein by reference in their entireties. Other aerosol precursors that may be employed include the aerosol precursors that have been incorporated in VUSE® products by R. J. Reynolds Vapor Company, the BLU™ products by Fontem Ventures B.V., the MISTIC MENTHOL product by Mistic Ecigs, MARK TEN products by Nu Mark LLC, the JUUL product by Juul Labs, Inc., and VYPE products by British American Tobacco. Also desirable are the so-called "smoke juices" for electronic cigarettes that have been available from Johnson Creek Enterprises LLC. Still further example aerosol precursor compositions are sold under the brand names BLACK NOTE, COSMIC FOG, THE MILKMAN E-LIQUID, FIVE PAWNS, THE VAPOR CHEF, VAPE WILD, BOOSTED, THE STEAM FACTORY, MECH SAUCE, CASEY JONES MAINLINE RESERVE, MITTEN VAPORS, DR. CRIMMY'S V-LIQUID, SMILEY E LIQUID, BEANTOWN VAPOR, CUTTWOOD, CYCLOPS VAPOR, SICBOY, GOOD LIFE VAPOR, TELEOS, PINUP VAPORS, SPACE JAM, MT. BAKER VAPOR, and JIMMY THE JUICE MAN. Embodiments of effervescent materials can be used with the aerosol precursor composition, and are described, by way of example, in U.S. Pat. App. Pub. No. 2012/0055494 to Hunt et al., which is incorporated herein by reference in its entirety. Further, the use of effervescent materials is described, for example, in U.S. Pat. No. 4,639,368 to Niazi et al.; U.S. Pat. No. 5,178,878 to Wehling et al.; U.S. Pat. No. 5,223,264 to Wehling et al.; U.S. Pat. No. 6,974,590 to Pather et al.; U.S. Pat. No. 7,381,667 to Bergquist et al.; U.S. Pat. No. 8,424,541 to Crawford et al; U.S. Pat. No. 8,627,828 to Strickland et al.; and U.S. Pat. No. 9,307,787 to Sun et al.; as well as U.S. Pat. App. Pub. No. 2010/0018539 to Brinkley et al. and PCT WO 97/06786 to Johnson et al., all of which are incorporated by reference herein in their entireties. Additional description with respect to embodiments of aerosol precursor compositions, including description of tobacco or components derived from tobacco included therein, is provided in U.S. Pat. App. Pub. Nos. 2018/0020722 and 2018/0020723, each to Davis et al., which are incorporated herein by reference in their entireties.

As noted, the tobacco material 110 may also include a flavorant. As used herein, reference to a "flavorant" refers to compounds or components that can be aerosolized and delivered to a user and which impart a sensory experience in terms of taste and/or aroma. Some examples of flavorants include, but are not limited to, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, rosemary, hibiscus, rose hip, yerba mate, guayusa, honeybush, rooibos, yerba santa, bacopa monniera, gingko biloba, withania somnifera, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Some examples of plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. The selection of such further components is variable based upon factors such as the sensory characteristics that are desired for the smoking article, their affinity for the tobacco material, their solubilities, and other physiochemical properties. The present disclosure is intended to encompass any such further components that are readily apparent to those skilled in the art of tobacco and tobacco-related or tobacco-derived products. See, e.g., Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. It should be noted that reference to a flavorant should not be limited to any single flavorant as described above, and may, in fact, represent a combination of one or more flavorants.

As noted above, in some embodiments, the smoking article 100 may comprise a thermal energy absorber 112 at least partially positioned between the tobacco material 110 and the carbon heat source 108. In various embodiments, the thermal energy absorber may be chosen from the group consisting of metals and ceramics. In some embodiments, the thermal energy absorber may be an aluminum (Al) or alumina ($Al_2O_3$) material. In some embodiments, the thermal energy absorbers may comprise any metal, ceramic, or other suitable material with a specific heat capacity from about 0.1 kJ/kg K to about 3 kJ/kg K, or preferably from about 0.5 kJ/kg K to about 2 kJ/kg K, or more preferably from about 0.75 kJ/kg K to about 1 kJ/kg K. The specific properties of materials suitable for use as thermal energy absorbers in the present disclosure may vary across specific embodiments. Suitable materials for use as thermal energy absorbers in the present disclosure may include, but are not limited to, materials with properties such as high thermal stability, suitable specific heat capacity, or high thermal conductivity. Further, suitable materials for use as thermal energy absorbers in the present disclosure may be non-toxic, non-hazardous materials with minimal negative health effect.

In some embodiments, thermal energy absorbers according to the present disclosure may be configured to increase uniform distribution of heated air across the tobacco material. In some embodiments, the thermal energy absorber may be configured to decrease a crest temperature of the smoking article by about 50° C. to about 500° C. In some embodiments, the thermal energy absorbers may be configured to decrease a crest temperature of the smoking article by at least about 50° C., or at least about 100° C., or at least about 150° C., or at least about 200° C., or at least about 250° C., or at least about 300° C., or at least about 350° C., or at least about 400° C., or at least about 450° C., or at least about 500° C. In some embodiments, the thermal energy absorber may be configured to deliver average crest temperatures in smoking articles below about 500° C., or below about 450° C., or below about 400° C., or below about 350° C., or below about 300° C., or below about 250° C., or below about 200° C., or below about 150° C.

In various embodiments, the thermal energy absorber may be configured to minimize the reduction of total particulate matter (TPM) released during smoking of the smoking article. Advantageously, thermal energy absorbers according to the present disclosure may be configured to deliver similar release of TPM during smoking of a smoking article with thermal energy absorbers as compared to a smoking article without thermal energy absorbers, thus producing visible aerosols with similar visual characteristics to those of a typical smoking article with the added benefits of the thermal energy absorbers. In some embodiments, the thermal energy absorbers may be configured to maintain a net pressure drop of between about −20 mmHg and about 20 mmHg, or between about −10 mmHg and about 10 mmHg, or about 0 mmHg in the smoking article while smoking, as compared to a control sample of the smoking article without thermal energy absorbers. Advantageously, thermal energy absorbers according to the present disclosure may be configured to deliver substantially the same pressure drop in a smoking article with thermal energy absorbers as compared to a smoking article without thermal energy absorbers, thus maintaining the same draw resistance to a user with the added benefits of the thermal energy absorbers.

In one or more embodiments, the thermal energy absorber may be in the form of one or more circular disks. In some embodiments, the one or more circular disks may further comprise a porous or non-porous material. In this regard, FIG. 3 illustrates a thermal energy absorber 112 in the form of a circular disk which comprises a plurality of holes 130 extending longitudinally therethrough. In some embodiments, the circular disks may have a diameter of about 5 mm to about 9 mm, or about 6 mm to about 8 mm, or about 7 mm. In certain embodiments, the circular disks may have a thickness of about 0.1 mm to about 4 mm, or about 1 to about 3 mm, or about 2 mm. Although in various embodiments, the thermal energy absorbers may have a variety of geometries and design parameters, including, for example, a substantially spherical shape or a triangular shape, the thermal energy absorbers 112 depicted in FIG. 3 have a generally cylindrical disk shape with a plurality of holes of substantially similar size and evenly spaced therethrough, although variable sizing and/or variable spacing are also encompassed. In various other embodiments, the plurality of holes 130 may be irregularly shaped, randomly distributed, distributed in a pattern, or distributed in any other configuration which may allow air flow through the thermal energy absorber. In some embodiments the individual holes may have a diameter of about 0.1 to about 1 mm, or about 0.2 mm to about 0.5 mm. The thermal energy absorber depicted in FIG. 3 was manufactured using an additive manufacturing technique for the precise manufacturing of the alumina disks with a diameter of 6.58 mm and a thickness of 1.5 mm. In the depicted embodiment, the plurality of holes 130 are evenly distributed across the circular disk in order to uniformly distribute heated air to the tobacco material downstream. In various other embodiments, the one or more circular disks may be sufficiently porous such that the plurality of holes I not necessary in the one or more circular disks. For example, in such embodiments, the one or more circular disks may comprise a metallic or ceramic material that is sufficiently porous so as to provide for a pressure drop in the smoking article that is lower than the maximum pressure drop limit in such smoking articles. The porosity may be in the range of macroscale porosity to nanoscale porosity. Further, such porous metallic or ceramic materials may be in the form of a foam material.

In some embodiments, the thermal energy absorber 112 may be in the form of a plurality of particles. In various embodiments, the particles may be substantially spherical in shape or may be irregularly shaped. In some embodiments, the shape of the particles may vary, for example, the particles may be substantially in the shape of a sphere, a cube, a cylinder, or any other suitable three-dimensional shape. In certain embodiments, the thermal energy absorber may comprise about 5 to about 500 particles, or about 7 to about 300 particles, or about 10 to about 100 particles, or about 12 to about 30 particles, or preferably about 15 to about 20 particles. In certain embodiments, the particles may have a diameter of between about 0.1 mm to about 5 mm, or about 0.5 mm to about 4 mm, or about 1 mm to about 3 mm, or about 2 mm. In some embodiments, particularly those such embodiments with a larger number of overall particles, the particles may have a diameter of less than about 0.1 mm, or less than about 0.05 mm, or less than about 0.01 mm, or less than about 0.005 mm. In some embodiments, a thermal energy absorber 112 in the form of a plurality of particles may be configured such that the number of particles, in the plurality of particles, gradually decreases in number the farther away the particles are from the heat source 108. For example, in some embodiments, the packing density of the thermal energy absorber particles may be at its highest close to the heat source and at its lowest furthest away from the heat source. Thus, in some embodiments, the packing density of the thermal energy absorber particles may be inversely proportional to the distance that said particles are from the heat source. In some embodiments, this inverse relationship may further provide for uniform heat distribution across the tobacco material. In various other embodiments, the thermal energy absorber can be in shape of hollow spheres. In some embodiments, the hollow portion of the hollow spheres may be filled with paraffin, wax, or any other suitable phase change materials. For example, hollow spheres according to such embodiments may provide for thermal energy absorbers with reduced mass and varying thermal properties.

As noted in FIG. 4, in one particular embodiment, a smoking article 100 according to the present invention may comprise a plurality of thermal energy absorbers 112 that may have substantially the same form or be present in substantially different forms. For example, as shown in FIG. 4, the thermal energy absorber 112 may include a first thermal energy absorbing component 112*a* that is in the form of one or more circular disks and may include a second thermal energy absorbing component 112*b* that is in the form of one or more particles (e.g., substantially spherical particles). In such embodiments, the first component 112*a* may be positioned between the tobacco material 110 and the carbon heat source 108, and the second component 112*b* may be comingled within the tobacco material 110. In some embodiments, the second component 112*b* may be configured such that the number of particles, in the plurality of particles, gradually decreases in number the farther away the particles are from the carbon heat source 108.

In various other embodiments, the present disclosure provides a method for reducing excess heating in a smoking article, the method comprising: providing a smoking article that comprises a carbon heat source, a tobacco material, a thermal energy absorber, and an outer wrap material circumscribing at least a portion of the smoking article, wherein the smoking article is defined by an upstream lighting end and a downstream mouth end; and positioning the thermal energy absorber at least partially between the tobacco material and the carbon heat source such that a crest temperature of the smoking article is decreased by between about 25° C. to about 75° C. and about 475° C. to about 525° C. when the carbon heat source is lit. In some embodiments, thermal energy absorbers prepared according the present method may be configured to decrease a crest temperature of the smoking article by at least about 50° C., or at least about 100° C., or at least about 150° C., or at least about 200° C., or at least about 250° C., or at least about 300° C., or at least about 350° C., or at least about 400° C., or at least about 450° C., or at least about 500° C. In some embodiments, thermal energy absorbers prepared according to the present method may be configured to deliver average crest temperatures in smoking articles below about 500° C., or below about 450° C., or below about 400° C., or below about 350° C., or below about 300° C., or below about 250° C., or below about 200° C., or below about 150° C. In some embodiments, the method according to the present disclosure may further include providing a thermal energy absorber that is configured to increase uniform distribution of heated air across the smoking article. In some embodiments, the method of the present disclosure may further include providing a filter material positioned proximate the downstream mouth end of the smoking article.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

EXAMPLES

To investigate the performance of the thermal energy absorbers described herein, samples of two different types of heat-not-burn cigarettes (hereinafter referred to as "HNB1" and "HNB2") were prepared and tested according to the following methods.

The HNB1 samples were hand-built with 13 mm×27 mm tipping patches which combined a tobacco beads section and a tobacco rod section. The thermal energy absorbers were embedded between the tobacco beads section and the carbon heater. A dual filter system with the length of 14 mm for the CA filter and length of 7 mm for the HAT filter was used in these samples. Overall, 31 samples were prepared according to this method, and are listed as follows:

5 HNB1 control samples
5 HNB1 samples with aluminum disks
3 HNB1 samples with alumina ceramic disks
3 HNB1 samples with 10 aluminum spheres
3 HNB1 samples with 15 aluminum spheres
3 HNB1 samples with 20 aluminum spheres
3 HNB1 samples with 10 ceramic alumina spheres
3 HNB1 samples with 15 ceramic alumina spheres
3 HNB1 samples with 20 ceramic alumina spheres The HNB2 samples were prepared with hand-built smoking articles including a 12 mm carbon tip (8 mm protruding from the paper wrap), 13 mm of substrate tobacco materials (caste sheet loaded with glycerin) after the carbon tip (covered by aluminum foil), 37 mm of tobacco rod (optionally loaded with glycerin), and 14 mm cellulose acetate filter followed by 7 mm hollow acetate tube. The HNB2 samples were then modified by making a straight cut in the tobacco rod between the carbon heater and the substrate tobacco section (with a depth of about 4 mm) at 12 mm (length of heat source) from the lit end of the tobacco rod using a utility knife. Next, the thermal energy absorbers were placed into the cut behind the heat source. Then, the straight cut was wrapped with 13 mm×27 mm tipping paper and the paper was glued to the rods to block any air gaps. Overall, 76 samples were prepared according to this method, and are listed as follows:

10 HNB2 reference samples
3 HNB2 samples with aluminum disks
3 HNB2 samples with ceramic alumina disks
3 HNB2 samples with 5 aluminum spheres
3 HNB2 samples with 8 aluminum spheres
3 HNB2 samples with 10 aluminum spheres
10 HNB2 samples with 15 aluminum spheres
10 HNB2 samples with 18 aluminum spheres
10 HNB2 samples with 20 aluminum spheres
3 HNB2 samples with 5 ceramic alumina spheres
3 HNB2 samples with 7 ceramic alumina spheres
3 HNB2 samples with 10 ceramic alumina spheres
3 HNB2 reference samples with menthol
3 HNB2 samples with 15 aluminum spheres with menthol
3 HNB2 samples with 18 aluminum spheres with menthol
3 HNB2 samples with 20 aluminum spheres with menthol

Example 1

Average Crest Temperature Profiles of Best Candidate HNB1 and HNB2 Samples with Thermal Energy Absorbers (FIG. 5)

Thermal analysis experiments were carried out on all HNB1 and HNB2 samples to provide temperature profiles along the cigarette rods. A hypodermic needle was used to drill 0.50 mm holes in two locations of the cigarette rods, 15 mm and 24 mm from the lit end. Next, K-type thermocouples (manufactured by Omega Engineering, Norwalk, CT) of 0.26-mm probe diameter were inserted into the holes and sealed with a small amount of tipping glue (20009766 glue). The insertion depth of the thermocouples was approximately 3.5 mm, which located the thermocouple tip at approximately the centerline of the cigarette rod. The HNB1 and HNB2 samples were held in place by a custom made labyrinth holder of the conventional design. The act of "smoking" was effectuated using a custom-made smoking machine with an MDrivePlus 17 stepping motor manufactured by Schneider Electric Motion USA. The stepping motor was programmed to the specific puff regimen described herein below. The use of a stepping motor enabled digital control of the piston movements. Finally, data collection was handled using an IntelliLogger (manufactured by Logic Beach, La Mesa, CA), and the HyperWare II software (manufactured by Logic Beach, La Mesa, CA) was used to transfer the data to the computer for further analysis.

Testing was performed on HNB1 and HNB2 samples containing circular aluminum disks; circular ceramic alumina disks; 5, 8, 10, 15, 18, and 20 aluminum spheres; and 5, 7, 10, 15, 18, and 20 ceramic alumina spheres. All products were smoked, using the custom-made smoking machine, to 19 puffs using a 55 mL puff volume with two second puff duration. The first three puffs were considered lighting puffs and were essentially performed back-to-back. The inter-puff interval between puffs 1 and 2 and puffs 2 and 3 was approximately three seconds. The heat source was pre-heated for approximately one second using an electric lighter (Borgwaldt Electric Lighter R29) prior to puff 1 and light contact was maintained between the lighter head and the heat source until the end of puff 2. Puff 3 was taken with the lighter removed from the heat source. Following puff 3, the intervals between the start of subsequent puffs was maintained at 30 seconds. The temperature of the tobacco core (rod center line) at the lengths of 15 mm and 24 mm were measured by the thermocouples and a temperature profile was generated from this data retrieved by the IntelliLogger.

The peak value of the temperature within each puff was identified and referred to as "crest temperature" of the puff. The samples that demonstrated a maximum temperature (collected at 15 mm) lower than that of the HNB2 control samples by 100° C. to 300° C. were selected as the high performance "best" candidates. Based on testing, the HNB2 samples with 15, 18, and 20 aluminum spheres were selected as the best candidates. As seen in FIG. 5, average crest temperature profiles were reported based on testing of control HNB2 rods without aluminum spheres, and HNB2 rods containing 15, 18, and 20 aluminum spheres. Sample HNB2 rods containing 18 aluminum spheres generated the largest decrease in crest temperatures (in excess of 300° C. decreases) while smoking; however, all three sample rods generated a decrease in crest temperature when compared to the control sample.

Example 2

Average Pressure Drop Data for Best Candidate HNB1 and HNB2 Samples with Thermal Energy Absorbers (FIG. 6)

For precise comparison of two cigarette rods containing different tobacco types or constituents, it is essential to evaluate and compare the average pressure drops along the rods. The air pressure drop is directly proportional to the resistance to air drawing force required for pulling aerosols through the rod and the filter. It is known, that the pressure drop and draw resistance of a cigarette have a direct influence on the performance of the cigarettes while smoking. The pressure drop unit incorporated in the quality test module (QTM) set-up was used to measure the air pressure drop of the samples. The QTM provided the percentage of dilution in the filter and pressure drop, measured and reported separately with the dilution holes open and the dilution holes closed. The dilution holes in the QTM test are prepared with a laser opening component that cuts a hole in the side of the tobacco rod downstream of the carbon-tip. For closed hole testing of samples, the dilution holes are covered while the QTM performs the test such that air only enters the samples from the carbon-tip. For the open hole testing of samples, the dilution holes are left uncovered while the QTM performs the test such that air enters the sample through both the carbon-tip and the dilution holes. The QTM has an industry standard protocol of drawing 17.5 $cm^3$ of air per second. The QTM also provided other physical properties of the samples including weight of the rods, and the circumference of the rods.

Specifically, in FIG. 6, a pressure drop analysis was conducted on candidate samples that were deemed to exhibit the best performance in the temperature analysis described in Example 1. The samples tested included HNB2 samples with 15, 18, and 20 aluminum spheres and the HNB2 control sample for comparison basis. As seen in FIG. 6, pressure drop data was reported, for both open and closed hole tests, based on testing of control HNB2 rods and HNB2 rods containing 15 aluminum spheres, HNB2 rods containing 18 aluminum spheres, and HNB2 rods containing 20 aluminum spheres. As noted in FIG. 6, the average pressure drop across HNB2 rods with aluminum spheres was between −5 mmHg and 10 mmHg when compared to control samples of the HNB2 rods that did not contain aluminum spheres. It was observed that the pressure drops in the HNB2 control sample as compared to the best candidate HNB2 samples were substantially similar. This confirms that the addition of the thermal energy absorbers did not significantly affect pressure drop across the HNB2 samples and lead to product performance changes in the user experienced draw resistance due to pressure drop alteration.

Example 3

Total Particulate Matter Released by Best Candidate HNB1 and HNB2 Samples with Thermal Energy Absorbers (FIG. 7)

The total particulate matter (TPM) released during smoking of a smoking article can affect the visibility of aerosols generated therefrom. For example, a decrease in the TPM released during smoking of a smoking article can decrease the visibility of the aerosol produced from said smoking article.

TPM analysis experiments were carried out using the custom-made smoking machine described in Example 1. The smoking machine was programmed to deliver a 50/30/3 puffing regimen (50 ml puff volume/30 second puff frequency/3 second puff duration) and was employed to quantify the total particulate matter (TPM) during smoking of the tested samples. A 44 mm diameter Cambridge filter pad was placed into a pad holder and weighed for initial mass. The holder was then connected to the smoking machine and a sample inserted. 12 puffs were performed on each sample. Subsequently the filter pad was removed from the holder and the final mass was measured using a high precision scale. The difference between the mass of the filter pads before and after each test yielded an overall TPM value which was averaged across 12 puffs to calculate the mass on a mg/puff basis for each sample tested.

As seen in FIG. 7, the samples tested included HNB2 samples with 15, 18, and 20 aluminum spheres and the HNB2 control sample for comparison basis. As seen in FIG. 7, the HNB2 control sample, HNB2 sample with 15 aluminum spheres, HNB2 sample with 18 aluminum spheres, and HNB2 sample with 20 aluminum spheres generated TPM values of 1.58, 1.17, 1.00, and 1.00 mg/puff, respectively. The results, as seen in FIG. 7, suggest that the TPM generated in the HNB2 control samples is only slightly higher than the TPM generated from HNB2 samples with thermal energy absorbers. Further, it was noted that the TPM values observed were inversely proportional to the number of aluminum spheres loaded into the HNB2 rods. Thus, the amount of visible aerosols produced in these samples is affected the least with fewer aluminum spheres while also providing a reduction in the scorching of the tobacco rod components. This testing also confirmed that the HNB2 sample with 15 aluminum balls provided the best combination of both minimal reduction in TPM values and maximum reduction in scorching of tobacco rod components.

What is claimed is:

1. A smoking article, comprising:

an outer wrap circumscribing at least a portion of the smoking article, wherein the smoking article is defined by an upstream lighting end and a downstream mouth end;

a carbon heat source positioned proximate the lighting end;

a tobacco material positioned downstream of the carbon heat source; and a thermal energy absorber at least partially positioned between the tobacco material and the carbon heat source, wherein the thermal energy absorber is in the form of a plurality of particles that are at least partially commingled within the tobacco material, wherein the smoking article is configured to produce a visible aerosol, and wherein the thermal energy absorber is configured to decrease a crest temperature of the smoking article by about 50° C. to about 500° C.

2. The smoking article of claim 1, wherein the thermal energy absorber comprises one or more of a metallic or ceramic material.

3. The smoking article of claim 1, wherein the thermal energy absorber comprises one or more of aluminum or an alumina material.

4. The smoking article of claim 1, wherein the thermal energy absorber is configured to increase uniform distribution of heated air across the tobacco material.

5. The smoking article of claim 1, wherein the thermal energy absorber further comprises one or more circular disks.

6. The smoking article of claim 5, wherein the one or more circular disks have an individual diameter of about 5 mm to about 9 mm and a thickness of about 0.1 mm to about 4 mm.

7. The smoking article of claim 5, wherein the one or more circular disks comprise a plurality of holes.

8. The smoking article of claim 7, wherein the plurality of holes are irregularly shaped, randomly-distributed, or distributed in a pattern.

9. The smoking article of claim 1, wherein the particles are substantially spherical in shape.

10. The smoking article of claim 1, wherein the thermal energy absorber comprises between about 3 to about 500 particles.

11. The smoking article of claim 9, wherein the particles have a diameter of about 0.005 mm to about 5 mm.

12. The smoking article of claim 1, wherein the thermal energy absorber comprises a material with a specific heat capacity of about 0.1 kJ/kg K to about 3 kJ/kg K.

13. The smoking article of claim 1, wherein the tobacco material further includes one or more of a tobacco extract, an aerosol precursor composition, and a flavorant.

14. The smoking article of claim 1, wherein the tobacco material is in one or more of a shredded or particulate form.

15. The smoking article of claim 1, wherein the carbon heat source has a plurality of air inlet holes extending longitudinally therethrough.

16. The smoking article of claim 1, wherein the downstream mouth end further comprises a filter material.

17. A method for reducing excess heating in a smoking article, the method comprising:

providing a smoking article that comprises a carbon heat source, a tobacco material, a thermal energy absorber, and an outer wrap circumscribing at least a portion of the smoking article, wherein the smoking article is defined by an upstream lighting end and a downstream mouth end; and positioning the thermal energy absorber at least partially between the tobacco material and the carbon heat source such that a crest temperature of the smoking article is decreased by about 50° C. to about 500° C. when the carbon heat source is lit.

18. The method of claim 17, wherein the thermal energy absorber is configured to increase uniform distribution of heated air across the tobacco material.

19. The method of claim 17, wherein the downstream mouth end further comprises a filter material.

* * * * *